US009927085B2

(12) United States Patent
Myojin

(10) Patent No.: US 9,927,085 B2
(45) Date of Patent: Mar. 27, 2018

(54) VEHICLE LIGHTING FIXTURE

(71) Applicant: Stanley Electric Co., Ltd., Tokyo (JP)

(72) Inventor: Norikatsu Myojin, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/094,560

(22) Filed: Apr. 8, 2016

(65) Prior Publication Data

US 2016/0305627 A1 Oct. 20, 2016

(30) Foreign Application Priority Data

Apr. 16, 2015 (JP) ..... 2015-084231

(51) Int. Cl.
*F21V 7/00* (2006.01)
*F21S 8/10* (2006.01)

(52) U.S. Cl.
CPC ..... *F21S 48/1364* (2013.01); *F21S 48/1159* (2013.01); *F21S 48/1225* (2013.01); *F21S 48/1329* (2013.01)

(58) Field of Classification Search
CPC ..... F21S 48/1364; F21S 48/1159; F21S 48/1225; F21S 48/1329
USPC ..... 362/516, 509, 520, 538
See application file for complete search history.

(56) References Cited

U.S. PATENT DOCUMENTS 6,280,064 B1 * 8/2001 Sato ..... F21V 7/09 362/257
8,425,090 B2 * 4/2013 Foo ..... F21V 7/048 362/241
2001/0003506 A1 * 6/2001 Natsume ..... F21S 48/23 362/518
2010/0321949 A1 * 12/2010 Ohno ..... F21S 48/1159 362/538

FOREIGN PATENT DOCUMENTS

JP 2012-119277 A 6/2012

* cited by examiner

*Primary Examiner* — Elmito Breval
*Assistant Examiner* — Glenn Zimmerman
(74) *Attorney, Agent, or Firm* — Kenealy Vaidya LLP

(57) ABSTRACT

A vehicle lighting fixture using a reflecting surface can be configured such that connecting surfaces cannot be visually recognized while having an excellent aesthetic appearance without not-shining portions when a light source is lit. The vehicle lighting fixture can include a paraboloidal reflecting surface, and a light source configured to emit light to be reflected by the reflecting surface, the reflecting surface including a plurality of projections and recesses to show a wavy vertical cross section and a wavy horizontal cross section.

11 Claims, 9 Drawing Sheets

VEHICLE LIGHTING FIXTURE

This application claims the priority benefit under 35 U.S.C. § 119 of Japanese Patent Application No. 2015-084231 filed on Apr. 16, 2015, which is hereby incorporated in its entirety by reference.

TECHNICAL FIELD

The presently disclosed subject matter relates to vehicle lighting fixtures, and in particular, to a vehicle lighting fixture using a reflecting surface.

BACKGROUND ART

There have been conventionally proposed vehicle lighting fixtures configured to use a reflecting surface, such as those disclosed in Japanese Patent Application Laid-Open No. 2012-119277.

FIG. 1 is a vertical cross-sectional view of a vehicle lighting fixture 210 described in Japanese Patent Application Laid-Open No. 2012-119277.

As illustrated in FIG. 1, the vehicle lighting fixture 210 can include a lens member 211 and a light source 212 (213). The lens member 211 can be configured to include an incident portion 211*a*, a reflecting surface 211*d* (including a plurality of individual total reflecting surfaces 211*d*1), and a light exiting surface 211*c*. When the light source 212 (213) is turned on to emit light, the light from the light source 212 (213) can enter the lens member 211 through the incident portion 211*a* and be reflected by reflecting surface 211*d* (211*d*1) to exit the lens member 211 through the light exiting surface 211*c*.

In the vehicle lighting fixture 210, the reflecting surface 211*d* is configured to include not only the plurality of individual total reflecting surfaces 211*d*1 but also a plurality of connecting surfaces 211*d*2, so that the cross section of the reflecting surface 211*d* shows a sawtooth shape. Here, the plurality of connecting surfaces 211*d*2 have no optical function but are used only for configuring the shape of the lens member 211. Therefore, the plurality of connecting surfaces 211*d*2 having no optical function can be visually observed through the light exiting surface 211*c*, thereby deteriorating the aesthetic appearance. Furthermore, when the light source 212 (213) is turned on to emit light, the light therefrom cannot be incident on the connecting surfaces 211*d*2. As a result, there arises a problem in that the connecting surfaces 211*d*2 may become not-shining portions.

SUMMARY

The presently disclosed subject matter was devised in view of these and other problems and features in association with the conventional art. According to an aspect of the presently disclosed subject matter, a vehicle lighting fixture using a reflecting surface can be configured such that connecting surfaces cannot be visually recognized while having an excellent aesthetic appearance without not-shining portions when a light source is lit.

According to another aspect of the presently disclosed subject matter, a vehicle lighting fixture can include a paraboloidal reflecting surface, and a light source configured to emit light to be reflected by the reflecting surface, the reflecting surface including a plurality of projections and recesses to show a wavy vertical cross section and a wavy horizontal cross section.

With this configuration, the vehicle lighting fixture can be visually observed without any connecting surface observed and have an excellent aesthetic appearance without not-shining portions when the light source is lit.

This is because the reflecting face can be configured by the plurality of projections and recesses as a single reflecting surface to ensure the tangential continuity.

According to another aspect of the presently disclosed subject matter, the vehicle lighting fixture of the aforementioned aspect can be configured such that the plurality of recesses can each have a lowermost point which is contained in a first paraboloidal surface having a focal point at or near the light source; the plurality of projections can each have an uppermost point appearing in the vertical cross section thereof so that the uppermost points are contained in a second paraboloidal surface having a focal point at or near the light source and a focal distance shorter than that of the first paraboloidal surface; and the plurality of projections can each have an uppermost point appearing in the horizontal cross section thereof so that the uppermost points are contained in a third paraboloidal surface having a focal point at or near the light source and a focal distance shorter than that of the first paraboloidal surface.

With this configuration, when the focal distance of the second paraboloidal surface is appropriately adjusted, the vertical length of a light distribution to be formed can be controlled. Furthermore, when the focal distance of the third paraboloidal surface is appropriately adjusted, the horizontal length of the light distribution to be formed can be controlled.

In the vehicle lighting fixture with the above-described configuration, the focal distance of the third paraboloidal surface can be set to be shorter than the focal distance of the second paraboloidal surface, so that the light distribution pattern can be formed to have a horizontal length longer than a vertical length thereof for use as a DRL light distribution pattern.

According to still another aspect of the presently disclosed subject matter, the vehicle lighting fixture of any of the aforementioned aspects can be configured to include a lens member that can include an incident surface on which the light from the light source can be incident to enter the lens member, the reflecting surface, and a light exiting surface through which the light having been reflected by the reflecting surface can exit. The reflecting surface can be formed from metal deposited on part of the lens member.

With this configuration, the vehicle lighting fixture with such a lens member including the reflecting surface can be visually observed without any connecting surface observed through the light exiting surface and have an excellent aesthetic appearance without not-shining portions when the light source is lit.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lights of the presently disclosed subject matter with reference to the accompanying drawings in accordance with exemplary embodiments.

Figure 1:
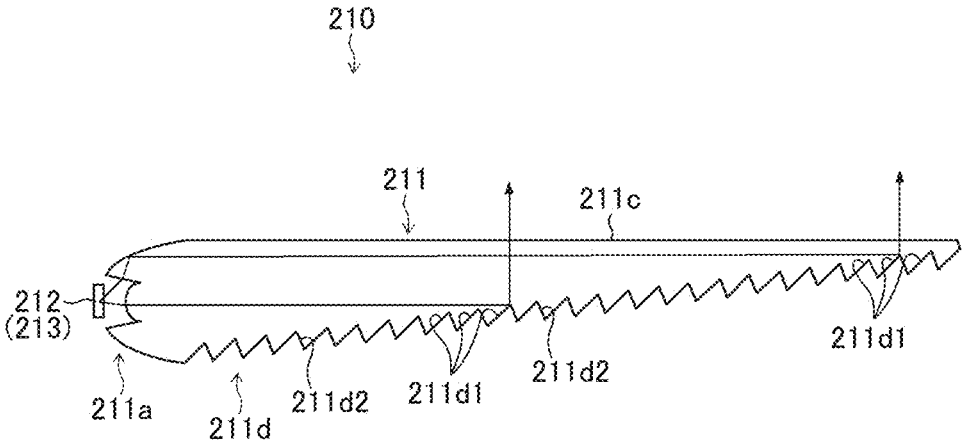
FIG. 1 Conventional Art
FIG. 1 is a longitudinal cross-sectional view of a vehicle lighting fixture described in Japanese Patent Application Laid-Open No. 2012-119277.
Figure 2:
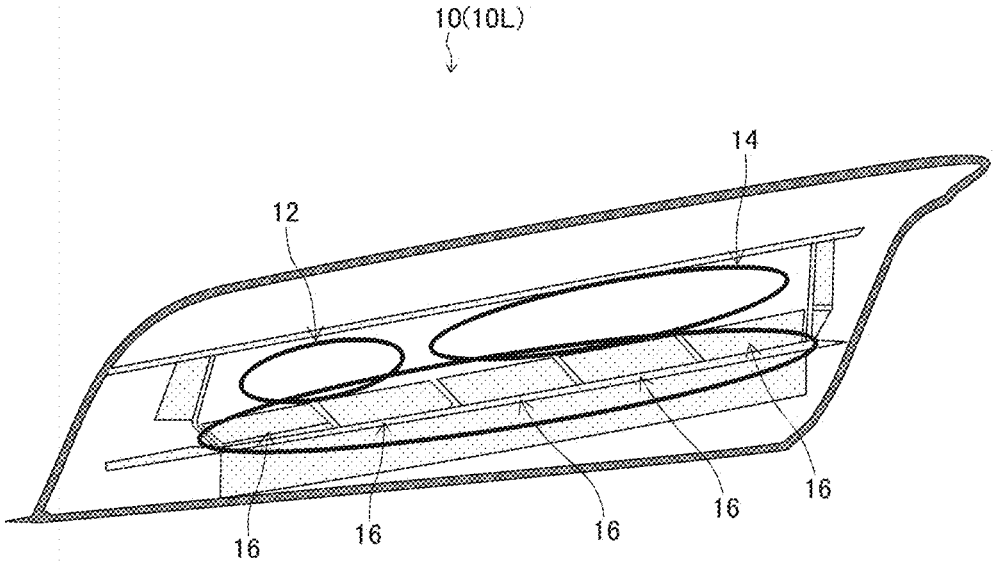
FIG. 2 is a schematic diagram illustrating a vehicle lighting fixture 10L made in accordance with principles of the presently disclosed subject matter, to be disposed on the right side of a front portion of a vehicle body.
Figure 3:
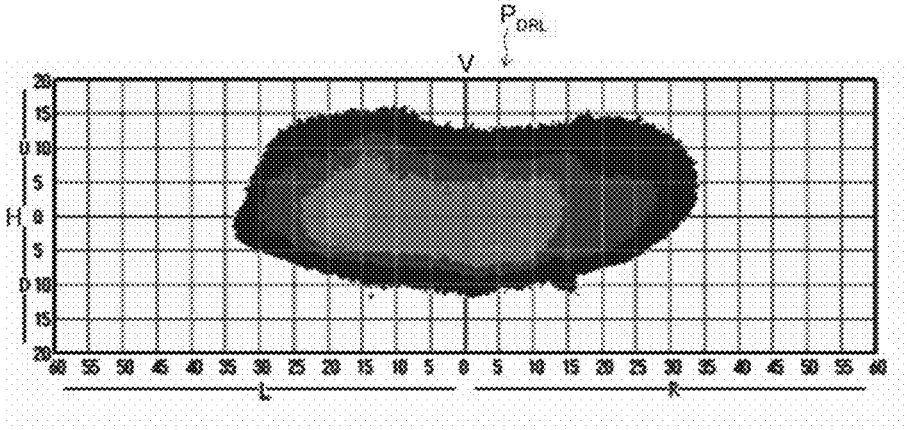
FIG. 3 is a diagram showing a DRL light distribution pattern $P_{DRL}$ formed by the vehicle lighting fixture 10L (DRL lighting unit 16) of FIG. 2, on a virtual vertical screen assumed to be disposed in front of the vehicle body about 25 meters away from the front portion of the vehicle body.
Figure 4A:
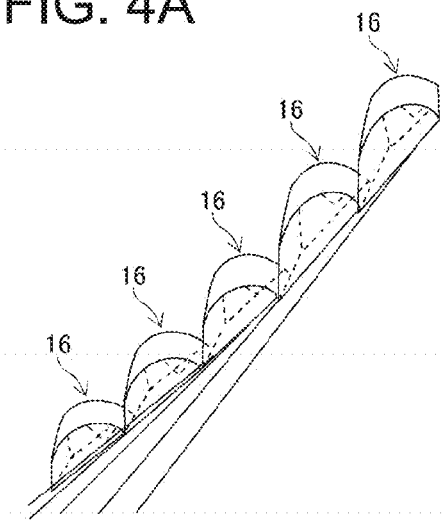
FIGS. 4A, 4B, 4C, and 4D are a top plan view, a front view, a perspective view, and a side view of the vehicle lighting fixture 10L (DRL lighting unit 16), respectively.
Figure 4C:
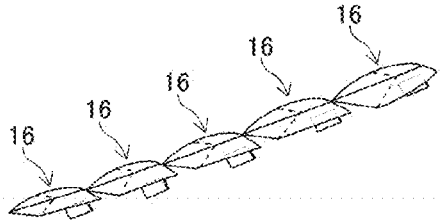
Figure 4B:
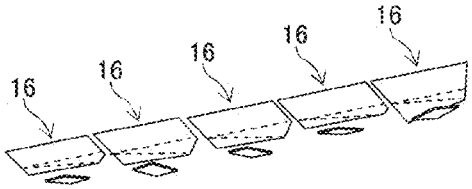
Figure 4D:
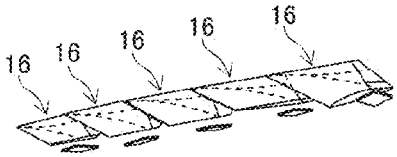

FIG. 2 is a schematic diagram illustrating a vehicle lighting fixture 10L made in accordance with the principles of the presently disclosed subject matter, to be disposed on the right side of a front portion of a vehicle body. FIG. 3 is a diagram showing a DRL light distribution pattern $P_{DRL}$ formed by the vehicle lighting fixture 10L (a DRL lighting unit 16), on a virtual vertical screen assumed to be disposed in front of the vehicle body about 25 meters away from the front portion of the vehicle body.

A vehicle lighting fixture 10 of the present exemplary embodiment can be constituted by a vehicle lighting fixture 10L, as illustrated in FIG. 2, to be disposed on the left front portion of the vehicle body and a not-illustrated vehicle lighting fixture to be disposed on a right front portion of the vehicle body. The vehicle lighting fixture to be disposed on the right side can basically have the same configuration as the vehicle lighting fixture 10L to be disposed on the left side in a bilaterally symmetric manner. Thus, a description for the vehicle lighting fixture 10L to be disposed on the left side will mainly be described while a description for the vehicle lighting fixture to be disposed on the right side will be omitted hereinafter.

The vehicle lighting fixture 10L can include a high-beam lighting unit 12, a low-beam lighting unit 14, a DRL lighting unit 16, and the like.

The high-beam lighting unit 12 can be configured to form a high-beam light distribution pattern and may be a known lighting unit. The low-beam lighting unit 14 can be configured to form a low-beam light distribution pattern and may be a known lighting unit.

The DRL lighting unit 16 can be configured to form a DRL light distribution pattern $P_{DRL}$ as shown in FIG. 3, and can include, for example, five DRL lighting units 16 disposed as illustrated in FIGS. 2 and 4A to 4D.

The five DRL lighting units 16 can have the same structure including a lens member 20 except that the lens members 20 can each have a different light exiting surface 20*c* in its shape. A description will now be given of one DRL lighting unit 16 on the left end side in FIGS. 4A to 4D as a representative unit.

Figure 5:
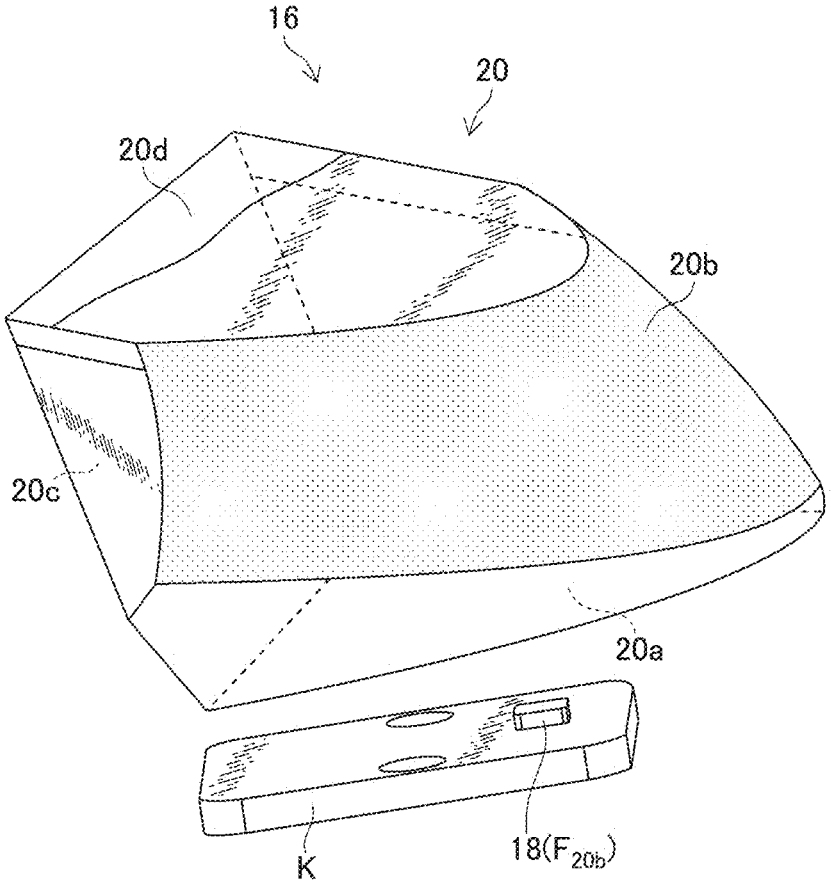
FIG. 5 is a perspective view of the DRL lighting unit 16 (including a lens member 20)

FIG. 5 is a perspective view of the DRL lighting unit 16 including the lens member 20.

FIGS. 6A, 6B, 6C, and 6D are atop plan view, a front view, a perspective view, and a side view of the DRL lighting unit 16 including the lens member 20, respectively. In the drawings, directions are illustrated by an X axis, a Y axis, and a Z axis where the X axis extends in a front-rear direction of the vehicle body, the Y axis is perpendicular to the X axis and extends in a horizontal plane containing the X axis direction, and the Z axis is perpendicular to the plane containing the X and Y axes.

Figure 7:
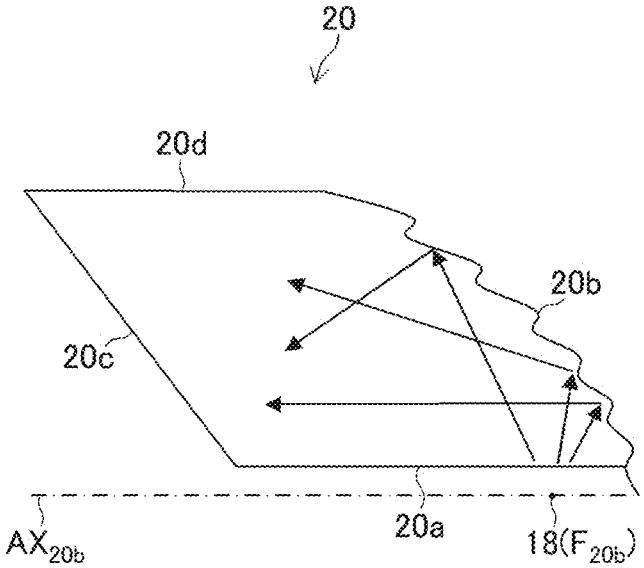
FIG. 7 is a schematic vertical cross-sectional view of the DRL lighting unit 16 including the lens member 20.

FIG. 7 is a schematic vertical cross-sectional view of the DRL lighting unit 16 including the lens member 20.

As illustrated in FIGS. 5 to 7, the DRL lighting unit 16 can include alight source 18 and the lens member 20 disposed above the light source 18. The lens member 20 can include a reflecting surface 20*b*, to be described later, having a focal point $F_{20b}$.

The light source 18 can be held by a not-illustrated holding member to be secured while maintaining a posture so that the light source 18 can emit light upward while the light source 18 can be located at or near the focal point $F_{20b}$ of the reflecting surface 20*b* of the lens member 20. The light source 18 can be configured as a white light source utilizing a combination of an LED element (LED chip) mounted on a substrate K and a wavelength converting member to emit light by the excitation with light from the LED element. The light source 18 can have alight emission surface with 250 lm, for example, and the light emission surface can have a rectangular shape with a width in a front-rear direction of 1 mm and a width in a vehicle width direction of 1 mm, for example. The light source 18 (light emission surface) can be disposed horizontally or inclined with respect to a horizontal plane. The light source 18 is not limited to the aforementioned white light source composed of the combination of the LED element and the wavelength converting member, but may be any of an incandescent bulb, a halogen bulb, an bulb, and a white light source composed of a combination of an LD element and a wavelength converting member.

The lens member 20 can be configured to include an incident surface 20*a*, a reflecting surface 20*b*, a light exiting surface 20*c*, and a top surface 20*d*. The lens member 20 can be formed by molding a transparent material such as glass, an acrylic resin, a polycarbonate resin, or the like.

The incident surface 20*a* can be configured to receive light from the light source 18 to allow the light to enter the lens member 20, and can be a planar surface in parallel with the light emission surface of the light source 18, although it may be a curved surface in accordance with a desired specification of the lens member 20.

As illustrated in FIG. 7, the reflecting surface 20*b* can be a substantial paraboloidal surface having a rotation axis $AX_{20b}$ extending in the front-rear direction of the vehicle body. The reflecting surface 20*b* can be formed by depositing aluminum or the like metal on part of the lens member, for example, in an area dot-hatched in FIG. 5. The reflecting surface 20*b* can include a plurality of projections and recesses (fine irregularities). In FIG. 7, the plurality of projections and recesses are drawn in an enlarged manner for facilitating the understanding of the reflecting surface 20*b*.

A description will now be given of production procedures of the reflecting surface 20*b* having the plurality of projections and recesses.

FIGS. 8A, 8B, 8C, and 8D are each an explanatory diagram for describing each procedure of producing the reflecting surface 20*b* including the plurality of projections and recesses.

Note that the following procedures may be performed using a predetermined simulation software.

Figure 8A:
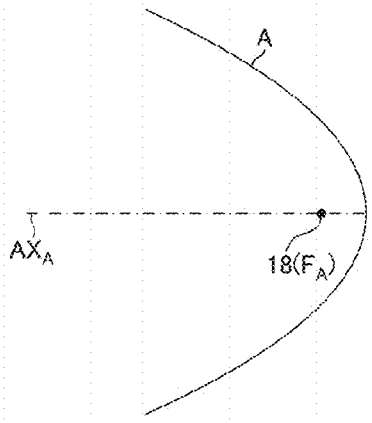
FIGS. 8A, 8B, 8C, and 8D are each an explanatory diagram for describing each procedure of producing a reflecting surface 20*b* including a plurality of projections and recesses.

First, as shown in FIG. 8A, a first paraboloidal surface A is formed to have a focal point $F_A$ at or near the light source 18. The F value (focal distance) of the first paraboloidal surface A is, for example, 17 mm. The first paraboloidal surface A can have a rotation axis $AX_A$ extending in the front-rear direction of the vehicle body.

Figure 8C:
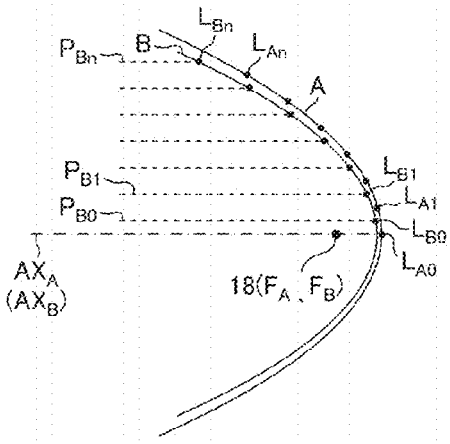
Figure 8B:
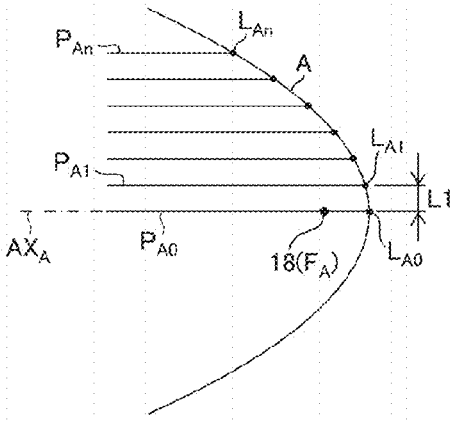

Next, as shown in FIG. 8B, a plane $P_{A0}$ (for example, horizontal plane) containing the light emission surface of the light source 18 and a plurality of planes $P_{A1}$ to $P_{An}$ are set. Then, lines of intersection $L_{A0}$ to $L_{An}$ formed between the first paraboloidal surface A and each of these planes $P_{A0}$ to $P_{An}$ are set. Here, distances L1 between the planes $P_{A0}$ to $P_{An}$ can be the same, but may be different from each other.

The distance L1 between the planes $P_{A1}$ to $P_{An}$, may preferably be 1/10 to 10 times the size of the light emission surface (portion) of the light source 18 although it depends on the size of the reflecting surface 20*b*. For example, when the light source 18 is a 1-mm square, L1 is preferably 0.1 mm to 10 mm. In the illustrated exemplary embodiment, the distance L1 between the planes $P_{A1}$ to $P_{An}$ is 1 mm. If the distance L1 between the planes $P_{A1}$ to $P_{An}$ is set to be equal to the size of the light emission surface of the light source 18 (1 mm×1 mm), the image of the light emission surface of the light source 18 can be reflected in the entire reflecting surface 20*b* when the light source 18 is not turned on, and when the light source 18 is turned on, the entire reflecting surface 20*b* can serve as a light emission portion.

If the distance L1 between the planes $P_{A1}$ to $P_{An}$ exceeds 10 times the size of the light emission surface of the light source 18, the light source 18 and its surrounding area are reflected in the reflecting surface 20*b* when the light source is not turned on, and when the light source 18 is turned on, the surrounding area become darkened and the light source 18 can be recognized as a point light source. On the other hand, if the distance L1 between the planes $P_{A1}$ to $P_{An}$ is made less than 1/10 times the size of the light emission surface of the light source 18, the technical difficulty in molding may be increased, resulting in deterioration of the surface accuracy during molding (for example, fine irregularities of a metal mold cannot be accurately transferred to a molded article).

Next, as shown in FIG. 8C, a second paraboloidal surface B having a focal point $F_B$ at or near the light source 18 and a focal distance shorter than that of the first paraboloidal surface A is formed. Here, the F value (focal distance) of the second paraboloidal surface A is, for example, 16.98 mm, which is shorter than the F value of the first paraboloidal surface A. The second paraboloidal surface B can have a rotation axis $AX_B$ coincident with the rotation axis $AX_A$ of the first paraboloidal surface A.

Next, these planes $P_{A0}$ to $P_{An}$ are vertically shifted by, for example, 0.5 mm to set planes $P_{B0}$ to $P_{Bn}$. Then, lines of intersection $L_{B0}$ to $L_{Bn}$ formed between the second paraboloidal surface B and each of these planes $P_{B0}$ to $P_{Bn}$ are set.

Figure 8D:
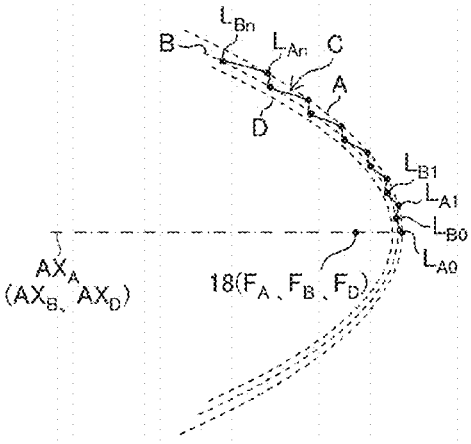

Then, as shown in FIG. 8D, each of the lines of intersection $L_{A0}$ to $L_{An}$ and adjacent one of the lines of intersection $L_{B0}$ to $L_{Bn}$ are connected to each other sequentially so as to ensure the tangential continuity. Specifically, each of the lines of intersection $L_{A0}$ to $L_{An}$ and adjacent one of the lines of intersection $L_{B0}$ to $L_{Bn}$ are connected to each other sequentially without any step to form a smooth continuous curved surface. In this manner, the vertical cross section of the reflecting surface 20*b* including the plurality of projections and recesses can be formed to show a wavy surface C.

In the same manner, the reflecting surface 20*b* having the plurality of projections and recesses can be formed to have a specific horizontal cross sectional shape by the following production procedures.

Specifically, planes $P_{C0}$ to $P_{Cn}$ (not shown) are set to be perpendicular to the planes $P_{A0}$ to $P_{An}$. Then, lines of intersection $L_{C0}$ to $L_{Cn}$ (not shown) formed between the wavy surface C and each of these planes $P_{C0}$ to $P_{Cn}$ are set. Here, distances between the planes $P_{C0}$ to $P_{Cn}$ can be the same (for example, 1 mm), but may be different from each other. Here, the plane $P_{C0}$ can be a plane containing the rotation axis $AX_A$ of the first paraboloidal surface A.

Next, as shown in FIG. 8D, a third paraboloidal surface D having a focal point $F_D$ at or near the light source 18 and a focal distance shorter than those of the first and second paraboloidal surfaces A and B is formed. Here, the F value (focal distance) of the third paraboloidal surface D is, for example, 16.96 mm, which is shorter than the F value of the second paraboloidal surface B. The third paraboloidal surface D can have a rotation axis $AX_D$ coincident with the rotation axis $AX_A$ of the first paraboloidal surface A.

Next, these planes $P_{C0}$ to $P_{Cn}$ are horizontally shifted in a direction toward the outer side of the vehicle body and perpendicular to the reference axis $AX_A$ (in the illustrated exemplary embodiment, leftward) by, for example, 0.4 mm to set planes $P_{D0}$ to $P_{Dn}$ (not shown). Then, lines of intersection $L_{D0}$ to $L_{Dn}$ (not shown) formed between the third paraboloidal surface D and each of these planes $P_{D0}$ to $P_{Dn}$ are set. Note that the DRL lighting unit 16 disposed on the left front portion of the vehicle body is configured such that the horizontally shifting direction of the planes $P_{C0}$ to $P_{Cn}$ is leftward while the unit disposed on the right front portion of the vehicle body is configured such that the horizontally shifting direction thereof is rightward due to the bilateral symmetry.

Then, each of the lines of intersection $L_{C0}$ to $L_{Cn}$ and adjacent one of the lines of intersection $L_{D0}$ to $L_{Dn}$ are connected to each other sequentially so as to ensure the tangential continuity. Specifically, each of the lines of intersection $L_{C0}$ to $L_{Cn}$ and adjacent one of the lines of intersection $L_{D0}$ to $L_{Dn}$ are connected to each other sequentially without any step to form a smooth continuous curved surface.

In this manner, the reflecting surface 20*b* including the plurality of projections and recesses can be produced.

Thus, the reflecting surface 20*b* including the plurality of projections and recesses can have a wavy vertical cross section as illustrated in FIG. 7 and a wavy horizontal cross section. Then, the plurality of recesses can each have a lowermost point which appears in the vertical and horizontal cross sections and is contained in the first paraboloidal surface A, as shown by black dots of $L_{A0}$ to $L_{An}$ in FIG. 8D. The plurality of projections can each have an uppermost point which appears in the vertical cross section thereof and is contained in the second paraboloidal surface B, as shown by black dots of $L_{B0}$ to $L_{Bn}$ in FIG. 8D. The plurality of projections can each have an uppermost point which appears in the horizontal cross section thereof and is contained in the third paraboloidal surface D.

The light emitted from the light source 18 can enter the lens member 20 through the incident surface 20*a*, and then be diffused and reflected in the vertical direction by the action of the vertical cross sectional shape (wavy form) of the reflecting surface 20*b* having the plurality of projections and recesses, as illustrated in FIG. 7 as well as the light can be diffused and reflected in the horizontal direction by the action of the horizontal cross sectional shape (wavy form) of the reflecting surface 20*b*.

Figure 6A:
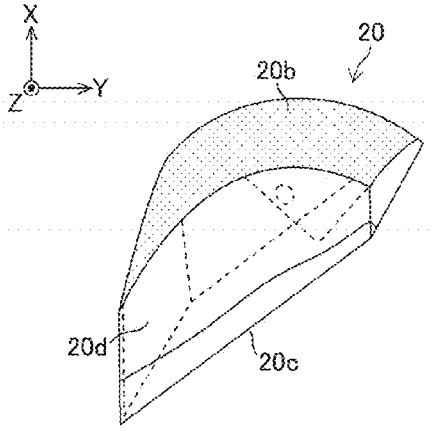
FIGS. 6A, 6B, 6C, and 6D are a top plan view, a front view, a perspective view, and a side view of the DRL lighting unit 16 (lens member 20), respectively.
Figure 6C:
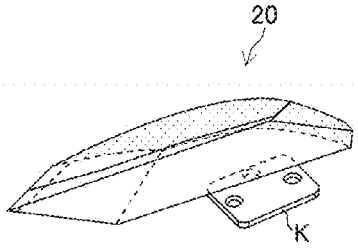

The light exiting surface 20*c* can allow the light reflected by the reflecting surface 20*b* to exit the lens member 20 therethrough. The light exiting surface 20*c* can also serve as a designed surface. The light exiting surface 20*c* can be designed in association with the design of a vehicle body, and in the illustrated exemplary embodiment, the light exiting surface 20*c* can be a flat plane inclined forward (the upper end portion thereof is positioned forward of the lower end portion) in the vertical cross section, as illustrated in FIG. 7. Furthermore, the light exiting surface 20*c* can be inclined sideward (the inward portion thereof is positioned forward of the outward (sideward) portion thereof) as illustrated in FIG. 6A. The light exiting surface 20*c* is not limited to the above-described design, but may be a curved surface.

In the illustrated exemplary embodiment, the reflecting surface 20*b* can be configured by a flat plane inclined by 65 degrees in a plane containing Y axis and Z axis while inclined by 36 degrees in a plane containing X axis and Z axis. The vertical and horizontal inclination angles of the light exiting surface 20*c* can be appropriately set in accordance with the vehicle body design and the like.

When the light exiting surface 20*c* is configured by a flat plane inclined such that the center portion thereof is positioned forward of the sideward portion thereof, the DRL light distribution pattern $P_{DRL}$ formed thereby can be a bilaterally asymmetric shape. This can be adjusted by controlling the shift amount of the planes $P_{C0}$ to $P_{Cn}$ in the horizontal direction when setting the planes $P_{D0}$ to $P_{Dn}$ to adjust the shape of the DRL light distribution pattern $P_{DRL}$ to a bilaterally symmetric shape. In view of this, in the illustrated exemplary embodiment, the planes $P_{C0}$ to $P_{Cn}$ are shifted by 0.4 mm in the horizontal direction when setting the planes $P_{D0}$ to $P_{Dn}$ so that the lines of intersection $L_{D0}$ to $L_{Dn}$ are formed between the third paraboloidal surface D and each of these planes $P_{D0}$ to $P_{Dn}$.

Figure 6B:
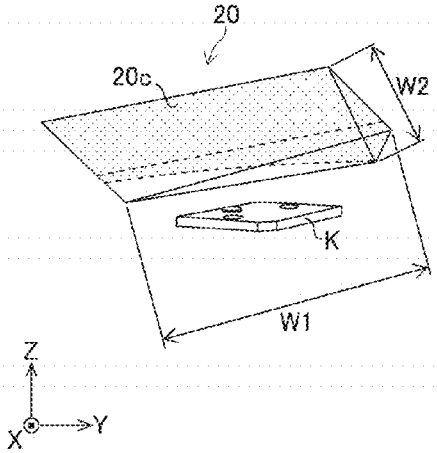
Figure 6D:
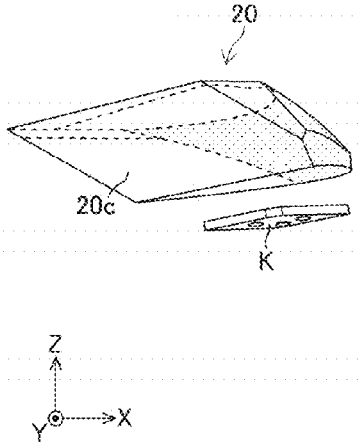

Examples of the size of the lens member 20 may include a long width W1 of 50 mm and a short width W2 of 25 mm in FIG. 6B.

A description will now be given of the DRL light distribution pattern $P_{DRL}$ formed.

Figure 9:
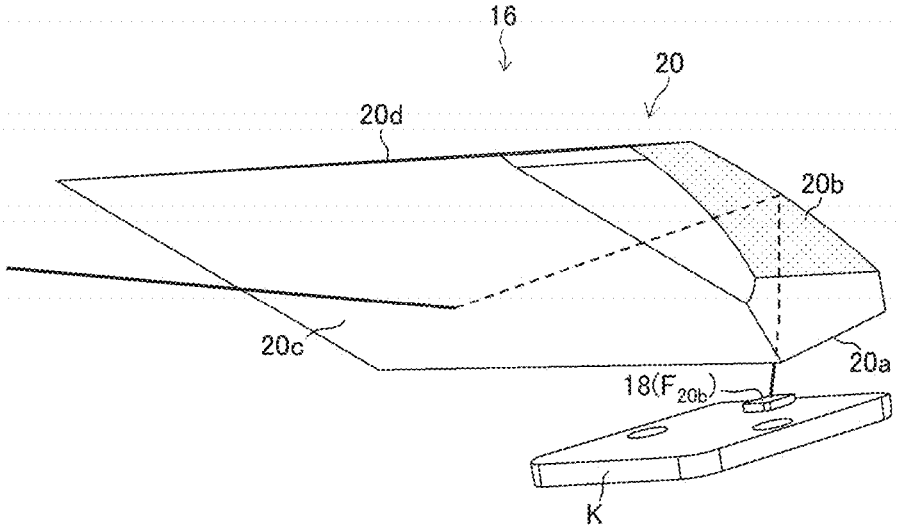
FIG. 9 is a perspective view illustrating optical paths through which the light emitted from a light source 18 enters the lens member 20 through a light incident surface 20*a*, is reflected by a reflecting surface 20*b*, and exits through a light exiting surface 20*c;*
Figure 10:
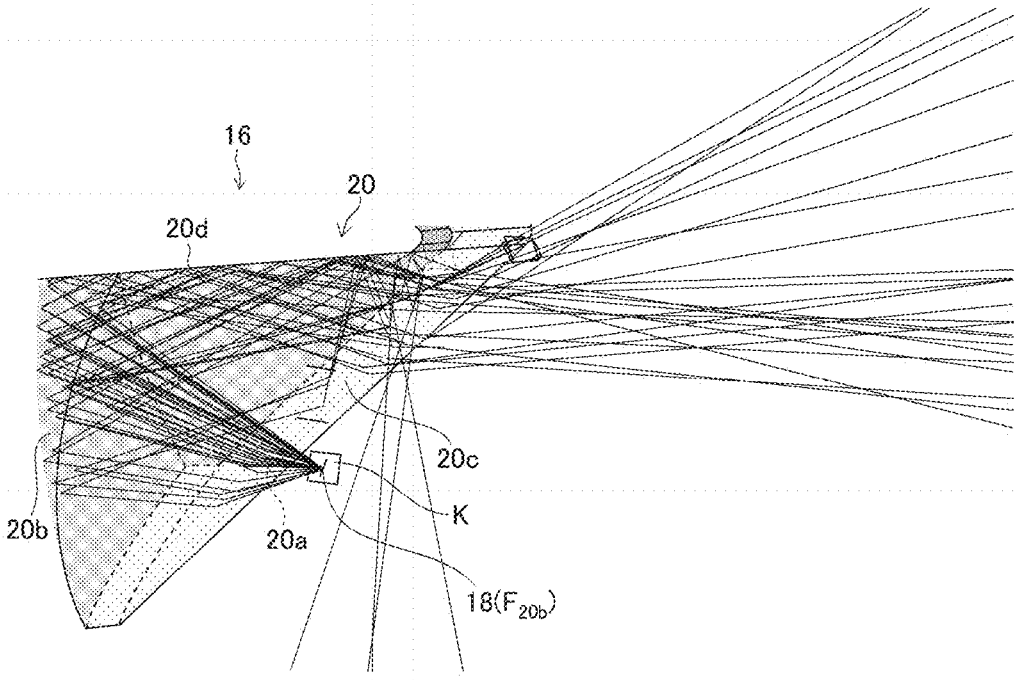
FIG. 10 is a diagram illustrating the lens member 20 in a direction substantially perpendicular to the light exiting surface 20*c*, for illustrating the optical paths through which the light emitted from the light source 18 enters the lens member 20 through the light incident surface 20*a*, is reflected by the reflecting surface 20*b*, and exits through the light exiting surface 20*c*.

FIGS. 9 and 10 are diagrams illustrating optical paths through which the light emitted from the light source 18 enters the lens member 20 through the light incident surface 20*a*, is reflected by the reflecting surface 20*b*, and exits through the light exiting surface 20*c*.

As illustrated in FIG. 9, the light emitted from the light source 18 can enter the lens member 20 through the incident surface 20*a*, be reflected by the reflecting surface 20*b*, and then be projected forward through the light exiting surface 20*c* to form the DRL light distribution pattern $P_{DRL}$ as illustrated in FIG. 3.

Figure 11:
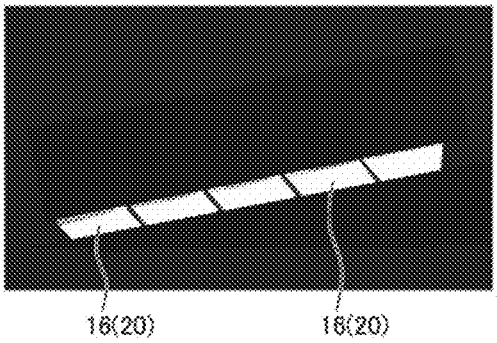
FIG. 11 is a diagram showing a state where five DRL lighting units 16 (lens member 20) emit light through the entire light exiting surface 20*c* as a result of simulation.

In some other cases, depending on a layout, the reflecting surface 20*b* cannot be formed in part and the light rays cannot be projected through the entire light exiting surface 20*c*. In this case, use of multiple reflections can achieve the entire emission. FIG. 10 shows the case where the reflecting surface 20*b* having the plurality of projections and recesses cannot be located on the upper part due to a not-illustrated structure positioned above the reflecting surface 20*b*. Even in this case, as illustrated in FIG. 10, the light rays that are emitted from the light source 18 and reflected by the reflecting surface 20*b* can further be reflected by the top surface 20*d* with a flat planar shape to exit through the light exiting surface 20*c* at its upper portion. Accordingly, the light exiting surface 20*c*, or the designed surface, including the upper portion thereof can project the light rays entirely and uniformly. FIG. 11 is a diagram showing a state where the five DRL lighting units 16 (lens member 20) emit light through the entire light exiting surface 20*c* as a result of simulation.

In these cases, since the vertical cross sectional shape of the reflecting surface 20*b* including the plurality of projections and recesses does not have a simple paraboloidal shape but the wavy shape, the light rays travelling through the lens member 20 can be diffused and reflected by reflecting surface 20 in the vertical direction. With this configuration, the DRL light distribution pattern $P_{DRL}$ can be formed to be diffused in the vertical direction as illustrated in FIG. 3.

When the F value (focal distance) of the second paraboloidal surface B is appropriately adjusted, the vertical length of the DRL light distribution $P_{DRL}$ can be controlled. For example, when the F value (focal distance) of the second paraboloidal surface B is increased to be close to that of the first paraboloidal surface A, the vertical length of the DRL light distribution $P_{DRL}$ can be shortened. Conversely, when the F value (focal distance) of the second paraboloidal surface B is decreased, the vertical length of the DRL light distribution $P_{DRL}$ can be elongated.

Similarly, since the horizontal cross sectional shape of the reflecting surface 20*b* including the plurality of projections and recesses does not have a simple paraboloidal shape but the wavy shape, the light rays travelling through the lens member 20 can be diffused and reflected by the reflecting surface 20 in the horizontal direction. With this configuration, the DRL light distribution pattern $P_{DRL}$ can be formed to be diffused in the horizontal direction as illustrated in FIG. 3.

When the F value (focal distance) of the third paraboloidal surface D is appropriately adjusted, the horizontal length of the DRL light distribution $P_{DRL}$ can be controlled. For example, when the F value (focal distance) of the third paraboloidal surface D is increased to be close to that of the first paraboloidal surface A, the horizontal length of the DRL light distribution $P_{DRL}$ can be shortened. Conversely, when the F value (focal distance) of the third paraboloidal surface D is decreased, the horizontal length of the DRL light distribution $P_{DRL}$, can be elongated.

In the illustrated exemplary embodiment, in order to form the DRL light distribution $P_{DRL}$ with horizontal length longer than a vertical length, the F value (for example, 16.96 mm) of the third paraboloidal surface D is set to be smaller than the F value (for example, 16.98 mm) of the second paraboloidal surface B.

As described above, the illustrated exemplary embodiment can provide the vehicle lighting fixture 10 using the lens member 20 having the reflecting surface 20*b* so that the vehicle lighting fixture 10 can be visually observed without any connecting surface observed and have an excellent aesthetic appearance without not-shining portions when the light source 18 is lit.

This is because the reflecting surface 20*b* can include the plurality of projections and recesses to show a wavy vertical cross section and a wavy horizontal cross section. Specifically, this is because the reflecting face 20*b* can be configured by the plurality of projections and recesses as a single reflecting surface to ensure the tangential continuity.

Furthermore, the conventional vehicle lighting fixture deteriorates the aesthetic appearance thereof due to the generation of bright lines and darkened areas by an optical surface (reflecting surface 211*d*) not to ensure the tangential continuity. In contrast thereto, the vehicle lighting fixture made in accordance with the principles of the presently disclosed subject matter can include an optical surface (reflecting surface 20*b*) configured to ensure the tangential continuity, resulting in excellent aesthetic appearance.

The conventional vehicle lighting fixture deteriorates the aesthetic appearance thereof due to the observation of the edge of the optical surface (reflecting surface 211*d*) that does not ensure the tangential continuity because the optical surface (reflecting surface 211*d*) is reflected in the designed surface (light exiting surface 211*c*) when the light source is not turned on. In contrast thereto, the vehicle lighting fixture made in accordance with the principles of the presently disclosed subject matter can have an excellent design due to the configuration of the optical surface (reflecting surface 20*b*) as a single reflecting surface that ensures the tangential continuity.

In addition, the conventional vehicle lighting fixture must have the light source (light source 212) to be disposed in a sideward position in the lengthwise direction of the designed surface (light exiting surface 211*c*). On the contrary, the vehicle lighting fixture made in accordance with the principles of the presently disclosed subject matter can improve the degree of freedom for the layout of the light source because the light source 18 may not be positioned in the sideward position in the length wise direction of the designed surface (light exiting surface 20*c*).

In addition, the conventional vehicle lighting fixture is difficult to achieve a continuous elongated light emission portion by a plurality of lens members (lens members 211) due to the light source (light source 212) to be disposed in the sideward position in the lengthwise direction of the designed surface (light exiting surface 211*c*). On the contrary, the vehicle lighting fixture made in accordance with the principles of the presently disclosed subject matter can achieve a continuous elongated light emission portion by a plurality of lens members (lens members 20) because the light source 18 may not be positioned in the sideward position in the length wise direction of the designed surface (light exiting surface 20*c*).

The conventional vehicle lighting fixture is configured such that since the light from the light source is condensed by the light incident portion and then enter the lens member, the light emission range extends in the vertical direction with respect to the light source (light emission surface) but does not extend in the horizontal direction, resulting in generation of darkened area on both sides of the light emission range extending in the vertical direction with respect to the light source (light emission surface). On the contrary, the vehicle lighting fixture made in accordance with the principles of the presently disclosed subject matter is configured not to converge the light at the incident surface 20*a* hardly converge the light). This means that the light emitted from the light source 18 can extend not only in the vertical direction but also in the horizontal direction with respect to the light source (light emission surface), which can advantageously be used to irradiate a wider area.

Furthermore, the vehicle lighting fixture made in accordance with the principles of the presently disclosed subject matter can be configured such that, when the F value (focal distance) of the second paraboloidal surface B is appropriately adjusted, the vertical length of the DRL light distribution $P_{DRL}$ to be formed can be controlled. Furthermore, when the F value (focal distance) of the third paraboloidal surface D is appropriately adjusted, the horizontal length of the DRL light distribution $P_{DRL}$ to be formed can be controlled.

Furthermore, the vehicle lighting fixture made in accordance with the principles of the presently disclosed subject matter can be configured such that a plurality of DRL lighting units 16 including the lens member 20 can be arranged in line without any gap between the adjacent lens members 20, which has been used as a space for a light source in the conventional vehicle lighting fixture. Thus, a single horizontally elongated light emitting portion configured by the light exiting surfaces 20C of the plurality of lens members 20.

In the exemplary embodiment, the description has been given of the case where the reflecting surface 20*b* including the plurality of projections and recesses is formed in the lens member 20 in part, but it is not limitative. In a modified example of the exemplary embodiment, a reflector can be used in place of the lens member 20 to serve as the reflecting surface 20*b*. In this case, there is no need to form the incident surface 20*a* and the light exiting surface 20C. When the reflector can serve as the reflecting surface 20*b* including the plurality of projections and recesses in place of the lens member 20, the entire reflecting surface 20*b* can project the light.

In the exemplary embodiment, the description has been given of the case where the vehicle lighting fixture can include the DRL lighting unit 16 configured to form the DRL light distribution pattern $P_{DRL}$ as illustrated in FIG. 3, but it is not limitative. In a modified example of the exemplary embodiment, the vehicle lighting fixture can serve as a turn signal lamp, a positioning lamp, a rear lamp, a stop lamp, or the like. Furthermore, the lighting fixture itself can be applied to other articles than the vehicle lighting fixture, such as a stage illumination device, an optical sensor, and the like.

Furthermore, the various numerical values shown in the exemplary embodiment(s) and the modified example(s) are illustrative and various suitable numerical values can be adopted as long as the advantageous effects of the presently disclosed subject matter can be exerted.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting fixture comprising:

a paraboloidal reflecting surface; and a light source configured to emit light to be reflected by the paraboloidal reflecting surface, the reflecting surface including a plurality of projections and recesses to show a wavy vertical cross section and a wavy horizontal cross section, wherein the light source is an LED element with a light emission surface having a predefined size, the plurality of recesses each have a lowermost point which is contained in a first paraboloidal surface having a focal point at or near the light source, the lowermost points of the recesses being set at respective intersections of the first paraboloidal surface and one of first planes parallel to a horizontal plane containing the light emission surface, the first planes being separated from each other by a distance not exceeding 10 times a width of the light emission surface.

2. The vehicle lighting fixture according to claim 1, further comprising a lens member that includes an incident surface on which the light from the light source can be incident to enter the lens member, the paraboloidal reflecting surface, and a light exiting surface through which the light having been reflected by the paraboloidal reflecting surface can exit, wherein the paraboloidal reflecting surface is formed from metal deposited on part of the lens member.

3. The vehicle lighting fixture according to claim 1, wherein the light from the light source is diffused and reflected by the reflecting surface in a vertical direction and a horizontal direction to form a DRL light distribution.

4. The vehicle lighting fixture according to claim 1, wherein the plurality of projections each have an uppermost point appearing in the vertical cross section thereof so that the uppermost points are contained in a second paraboloidal surface having a focal point at or near the light source and a focal distance shorter than that of the first paraboloidal surface, and the uppermost points of the projections being set at respective intersections of the second paraboloidal surface and one of second planes parallel to the horizontal plane containing the light emission surface, the second planes being shifted from the first planes and separated from each other by the distance.

5. The vehicle lighting fixture according to claim 2, wherein the light from the light source is diffused and reflected by the reflecting surface in a vertical direction and a horizontal direction to form a DRL light distribution.

6. A vehicle lighting fixture comprising:

a paraboloidal reflecting surface; and a light source configured to emit light to be reflected by the paraboloidal reflecting surface, the reflecting surface including a plurality of projections and recesses to show a wavy vertical cross section and a wavy horizontal cross section, wherein:

the plurality of recesses each have a lowermost point which is contained in a first paraboloidal surface having a focal point at or near the light source;

the plurality of projections each have an uppermost point appearing in the vertical cross section thereof so that the uppermost points are contained in a second paraboloidal surface having a focal point at or near the light source and a focal distance shorter than that of the first paraboloidal surface; and the plurality of projections each have an uppermost point appearing in the horizontal cross section thereof so that the uppermost points are contained in a third paraboloidal surface having a focal point at or near the light source and a focal distance shorter than that of the first paraboloidal surface.

7. The vehicle lighting fixture according to claim 6, wherein the focal distance of the third paraboloidal surface is set to be shorter than the focal distance of the second paraboloidal surface.

8. The vehicle lighting fixture according to claim 6, further comprising a lens member that includes an incident surface on which the light from the light source can be incident to enter the lens member, the paraboloidal reflecting surface, and a light exiting surface through which the light having been reflected by the paraboloidal reflecting surface can exit, wherein the paraboloidal reflecting surface is formed from metal deposited on part of the lens member.

9. The vehicle lighting fixture according to claim 6, wherein the light source is a white light source including an LED element.

10. The vehicle lighting fixture according to claim 7, further comprising a lens member that includes an incident surface on which the light from the light source can be incident to enter the lens member, the paraboloidal reflecting surface, and a light exiting surface through which the light having been reflected by the paraboloidal reflecting surface can exit, wherein the paraboloidal reflecting surface is formed from metal deposited on part of the lens member.

11. The vehicle lighting fixture according to claim 9, wherein the light from the light source is diffused and reflected by the reflecting surface in a vertical direction and a horizontal direction to form a DRL light distribution.

* * * * *